United States Patent [19]

Ryden

[11] 4,155,454

[45] May 22, 1979

[54] SAFETY PACKAGING FOR AMPOULES

[75] Inventor: John V. Ryden, Summit, N.J.

[73] Assignee: Schering Corporation, Kenilworth, N.J.

[21] Appl. No.: 758,737

[22] Filed: Jan. 12, 1977

[51] Int. Cl.[2] ..... B65D 73/00; B65D 77/04

[52] U.S. Cl. ..... 206/532; 206/461; 206/470; 206/601

[58] Field of Search ..... 206/219, 461, 467, 469, 206/470, 471, 497–498, 528, 532, 601; 215/32

[56] References Cited

U.S. PATENT DOCUMENTS

| | | | |
|---|---|---|---|
| 2,893,547 | 7/1959 | Earl et al. | 206/219 |
| 3,075,639 | 1/1963 | Lingley | 206/469 X |
| 3,472,368 | 10/1969 | Hellstrom | 206/469 |
| 3,521,805 | 7/1970 | Ward | 206/532 X |
| 3,748,098 | 7/1973 | Dutch | 206/471 X |
| 3,862,684 | 1/1975 | Schmitt | 206/484 X |
| 3,913,734 | 10/1975 | Siegel | 206/498 |

FOREIGN PATENT DOCUMENTS

| | | | |
|---|---|---|---|
| 2248824 | 5/1975 | France | 215/32 |

*Primary Examiner*—Steven E. Lipman

*Attorney, Agent, or Firm*—Vincent H. Gifford; Bruce M. Eisen

[57] ABSTRACT

A safety package for an ampoule comprising a backing card, a cover sheet and an ampoule. The ampoule and the cover sheet are adapted to rupture upon the application of pressure to the backing card. The fractured segments of the ampoule are retained on the backing card, thereby minimizing the risk of glass splintering and cut fingers. After folding, the backing card provides a firm support which prevents ampoule spilling, and facilitates the filling of a syringe.

13 Claims, 6 Drawing Figures

SAFETY PACKAGING FOR AMPOULES

BACKGROUND OF THE INVENTION

The present invention relates to a safety package for an ampoule. It minimizes the risk of cut fingers, glass splinters, contamination and spilling, problems which are often associated with the opening of an ampoule. It also provides a convenient surface area for product identification and can be packaged in compact strips. The package is easy to handle and prevents ampoule breakage occurring when an ampoule accidentally rolls from a shelf during storage.

Ampoules are widely used as containers for aseptic or sterile compositions in the pharmaceutical and biological industries, particularly for the sterile packaging of injectable solutions. Product information, such as the batch number and expiration date, is normally printed on the ampoule directly, or on a paper or plastic label which is then affixed to the body of the ampoule surface.

Ampoules containing sterile drugs are preferably made of glass which provides a very effective seal against contamination. The glass ampoules normally have a cylindrical body part, a restricted neck and an expanded tip, the end of which is flame sealed after the ampoule has been filled with the sterile composition. Frequently the restricted neck is weakened by acid etching. Traditionally, the ampoule is opened by manually fracturing it at the restricted neck portion in one quick snapping movement. Unfortunately, this technique often results in hazardous, sharp, jagged edges which can injure the user's fingers, and glass splinters which can contaminate the sterile composition. If the user carelessly applies an excessive force to the ampoule, it is possible that the entire tip portion will shatter.

Ampoules also have the disadvantage, when they are stored in the conventional manner as taught by U.S. Pat. No. 2,672,980, of having an external surface area which can become contaminated either during storage or with the user's fingers. If the restricted portion of the ampoule is contaminated, it is possible that after opening, the ampoule contents will also become contaminated.

A further disadvantage of conventional ampoules is the likelihood of spilling the contents if the ampoule is used to fill a hypodermic syringe. The syringe is usually filled after the fractured ampoule has been placed on a horizontal surface, such as a table. Unfortunately, the ampoule container is relatively unstable in this position and is easily spilled either during the filling operation or if the table is slightly jarred. Another technique used to fill the syringe involves holding the ampoule in one hand and filling the syringe with the other hand. As expected, this technique requires a degree of dexterity which not all people possess.

SUMMARY OF THE INVENTION

The present invention provides a safety package for ampoules which eliminates the above recited disadvantages inherent in ampoules. This is accomplished by mounting the ampoule on a backing card with a cover sheet whereby upon the application of pressure to the weakened portion of the ampoule, through the backing card, both the ampoule and the cover sheet rupture. Opening the ampoule in this manner is relatively safe since it avoids the cut fingers, splinters, contamination and spillage which have accompanied the use of ampoules. In the packaging art, the assembled safety package would generally be referred to as a skin, shrink or blister package.

Skin packaging generally refers to a package comprising an air pervious backing card upon which the article is supported by a relatively thin thermoplastic film which is softened by heating. Suction is drawn through the substrate (backing card) to draw the heat softened film into a sheath or "skin" about the ampoule and into contact with the backing card. The cover sheet can be attached to the backing card by an adhesive material or heat sealing.

Shrink packaging is similar to skin packaging, and the terms are often used interchangeably. However, shrink packaging generally refers to the technique wherein the plastic film is first stretched, while hot, to form a relatively large cavity to accommodate the ampoule. After the ampoule has been positioned in the cavity the film is heated to shrink it into tight abutment with the product. This method is preferable to skin packaging if the pharmaceutical composition in the ampoule is heat sensitive.

A blister or bubble package generally comprises a cup which is molded from a relatively heavy plastic film and is contoured to the shape of the article. This cup, known as a bubble or blister, provides a preformed cavity of sufficient size to receive the ampoule. The bubble is formed with a peripheral flange so that it can be attached to the backing card by an appropriate means, e.g. heat fusion or a heat-sealed coating.

The backing card, which is preferably cardboard, provides a convenient surface area on which to display product information. For example, the product name, manufacturer, batch number and product expiration date can be readily printed on the peripheral flange portion surrounding the ampoule, and the instructions for opening the package or using the contents can be printed on the rear side of the backing card. The cover sheet is preferably transparent so that the user can conveniently inspect the appearance of the ampoule contents. If the ampoule contents are light sensitive, an opaque or ultraviolet absorbing cover sheet material could readily be used.

The ampoule safety package can be manufactured in strips with a scored or perforated weakened section between adjacent packages. If storage space is at a premium, as is commonly the case in hospital pharmacies, individual strips can be nested with one another. This can even be accomplished in a single strip by incorporating at intervals a blank section which is approximately $\frac{1}{3}$ to $\frac{1}{2}$ the width of an ampoule backing card. The strip is bent along both edges of the blank section such that the ampoule side of each of the two resulting strip sections are facing one another in a nested relationship.

BRIEF DESCRIPTION OF THE DRAWINGS

FIGS. 1 and 2 show an ampoule 1 in a skin or shrink package 2. The package comprises a backing card 3 and a pliable transparent cover sheet means 4 which forms a sheath over the ampoule. The ampoule is filled with an aseptic or sterile composition, such as liquid 5, and comprises a container portion 6, a restricted portion 7 and a tip portion 8. The restricted portion 7 can be weakened as with acid etching 16. In a preferred embodiment the backing card could be weakened along the axis of the ampoule restricted portion 7 as shown by perforations 9 or formed with an integral hinge as shown in FIG. 5. If package 2 is a shrink package, a suction or air evacuation means, such as hole 10, could be integrally formed on the card.

FIG. 3 shows a plurality of ampoules mounted on a strip of blister packages 2'. Each blister package comprises a backing card 3' and a relatively thick and rigid cover sheet 4'. The cover sheet can optionally contain a cut out portion 11 or be weakened in a conventional manner. The backing card can optionally be weakened as shown at 9'.

Adjacent ampoule safety packages 2' are separated by a scored or perforated weakened section 12 so that an individual safety package can be easily removed from the strip for use. If storage space is at a premium the strip can contain a blank section 13, which is approximately $\frac{1}{3}$ to $\frac{1}{2}$ the width of the ampoule backing card. During storage the strip is bent along the weakened sections 12 on each side of the blank section 13 such that the two portions of the strip on each side of the blank section will face one another in a nested relationship. In this position they can be compactly stored.

Figure 1:
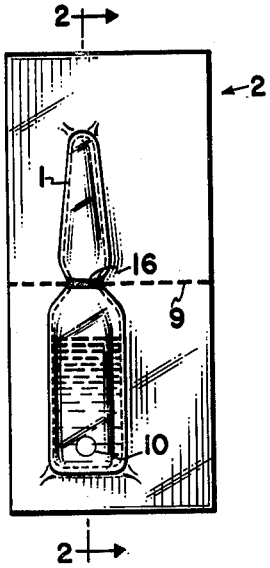
FIG. 1 is a front view of a skin or shrink ampoule safety package.
Figure 2:
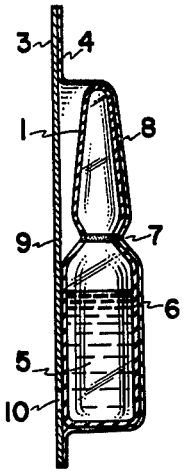
FIG. 2 is a sectional view along the lines 2—2 of FIG. 1.
Figure 3:
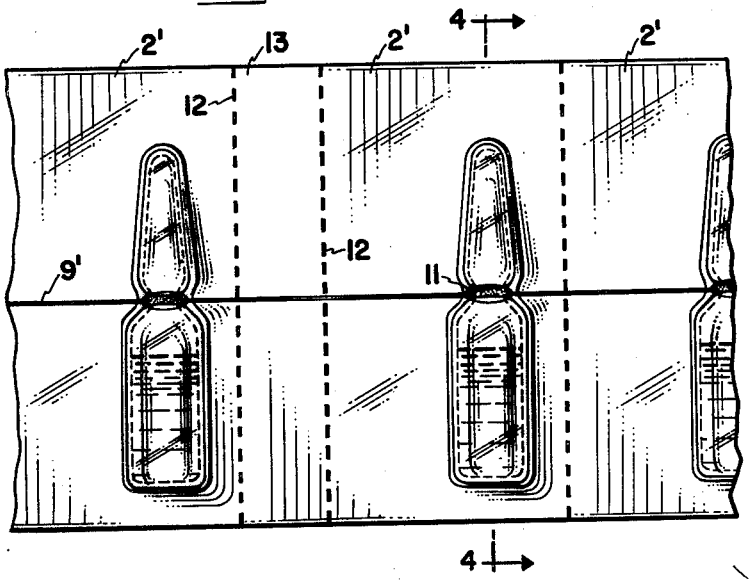
FIG. 3 is a front view of a strip of blister or bubble safety packages.
Figure 4:
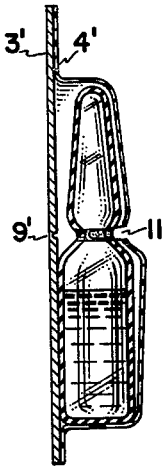
FIG. 4 is a sectional view along the lines 4—4 of FIG. 3.
Figure 5:
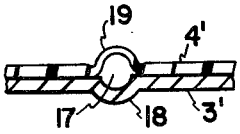
FIG. 5 is an expanded view of a preferred hinge means which is integrally formed in the package along the axis of the ampoule weakened section.

FIG. 5 is an expanded view of a hinge means 17 which can be integrally formed in the pliable package material along the axis of the ampoule weakened section. The preferred hinge shown in FIG. 5 comprises a scored indent 18 in the backing card and an optional corresponding scored indent 19 in the cover sheet. The hinge prevents separation of the two package sections at the bend line after the ampoule and the cover sheet have been ruptured. Separation of the two sections is undesirable since the misplacing of a separated top section could result in the loss of any product information which is printed on either the front or rear surface of the top portion. Separation would also prevent the filling of a syringe in the manner shown in FIG. 6.

Figure 6:
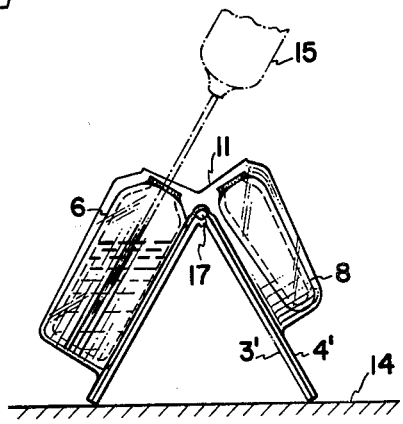
FIG. 6 is a side view of an ampoule in operative position for the filling of a hypodermic syringe.

FIG. 6 shows a ruptured ampoule package positioned on a horizontal surface, e.g. table 14, before filling a syringe 15. The FIG. 6 embodiment employs the hinge 17 of FIG. 5. As is apparent in FIG. 6, the ampoule contents are less likely to spill during this syringe filling operation than during the conventional filling operations discussed above.

In a skin or shrink package the cover sheet would securely hold the ampoule to the backing card. In a blister package the ampoule would generally be less securely held to the card than in a skin package. The blister could, however, be formed to the exact dimensions of the ampoule if it was deemed desirable. A suitable blister material would be a 0.0075 inch PVC, and a suitable shrink or skin material would be a 0.0005 heat shrinkable vinyl.

Although the invention has been described with reference to the embodiments shown, various changes and modifications may be made therein without departing from the spirit and scope of the invention.

What is claimed is:

1. Safety packaging for an ampoule comprising:
a backing card;
a glass ampoule having a weakened section; and
a cover sheet means to retain said ampoule onto said backing card, said cover sheet means having a weakened portion adjacent to and aligned with said ampoule weakened section; said ampoule and said cover sheet means are adapted to rupture essentially simultaneously upon the application of pressure to said weakened section and said weakened portion through said backing card, and wherein said cover sheet means is further adapted to affix the detached portions of said ampoule to said backing card after said ampoule has been ruptured.

2. A package as in claim 1 in which said weakened section is a restricted section.

3. A package as in claim 1 in which said backing card has a weakened portion which is adjacent to and aligned with said ampoule weakened section.

4. A package as in claim 1 in which said backing card and said cover sheet comprise a skin or shrink package.

5. A package as in claim 1 in which said cover sheet is transparent.

6. An ampoule package as in claim 1 wherein said backing card has a means for self-supporting said ruptured ampoule on a horizontal surface in a substantially upright position to avoid spilling the ampoule contents.

7. An ampoule package as in claim 1 further comprising an integral hinge means, aligned with said ampoule weakened section, for preventing separation of the backing card after said ampoule is ruptured.

8. An ampoule package as in claim 7 wherein said hinge means comprises a scored indent in said backing card.

9. An ampoule as in claim 13 wherein said hinge means further comprises a corresponding scored indent in said cover sheet.

10. A strip of ampoule safety packages comprising a plurality of said packages of claim 1 wherein each of said packages is separated by a weakened section.

11. A strip of ampoule safety packages as in claim 10 further comprising a blank section means, located between two adjacent packages, for storing the packages in a nested relationship.

12. Safety packaging for an ampoule comprising:
a backing card;
an ampoule having a weakened section;
a cover sheet means to retain said ampoule on said backing card, said cover sheet means having a cutout portion adjacent to and aligned with said weakened section; said ampoule and said cover sheet means are adapted to rupture essentially simultaneously upon the application of pressure to said weakened section and said weakened portion through said backing card, wherein said cover sheet means is further adapted to affix the detached portions of said ampoule to said backing card after said ampoule has been ruptured, and further wherein said backing card and said cover sheet means comprise a blister package.

13. A method of safely removing the liquid contents of an ampoule with a weakened section which is mounted on a backing card by means of a cover sheet comprising the steps of:
rupturing said ampoule and said cover sheet by applying pressure to said ampoule through said backing card and retaining the separated ampoule sections on said backing card, folding the backing card along the axis of said weakened section, placing said folded backing card on a horizontal surface without spilling the contents of said ampoule, and withdrawing said liquid contents with a syringe.

* * * * *